United States Patent [19]

Koga

[11] Patent Number: 4,966,121

[45] Date of Patent: Oct. 30, 1990

[54] APPARATUS FOR ENHANCING ENGINE PERFORMANCE

[76] Inventor: Fusamitsu Koga, 45-4 Takada, Maebaru-machi, Itoshima-gun, Fukuoka-ken, Japan

[21] Appl. No.: 444,283

[22] Filed: Dec. 1, 1989

[30] Foreign Application Priority Data

Jun. 27, 1989 [JP] Japan ..... 1-162735

[51] Int. Cl.[5] ..... F02M 33/00

[52] U.S. Cl. ..... 123/536

[58] Field of Search ..... 123/536, 537, 538, 539

[56] References Cited

U.S. PATENT DOCUMENTS 3,537,829 11/1970 Ott ..... 123/536
4,401,089 8/1983 Csaszar et al. ..... 123/536
4,476,817 10/1984 Lindberg ..... 123/536

FOREIGN PATENT DOCUMENTS 4026281 11/1965 Japan .
475862 2/1972 Japan .
4724765 7/1972 Japan .
4947922 12/1974 Japan .

OTHER PUBLICATIONS

"The Year Book of High Technology and Science" 1989, pp. 548 to 550.

*Primary Examiner*—Andrew M. Dolinar
*Assistant Examiner*—M. Macy
*Attorney, Agent, or Firm*—Ronald P. Kananen

[57] ABSTRACT

An engine performance enhancing apparatus comprises a plurality of disklike copper pieces arranged lattice-wise and sandwiched between two sheets or cloths, sheets of copper mesh superposed, one each on the opposite outer surface of the sheets or cloths, and aluminum sheets superposed and fastened on the opposite outer surfaces of the copper mesh.

This apparatus, on being simply disposed near an engine, brings about a beneficial effect of enhancing the output of the engine and, at the same time, decreasing the content of noxious substances in the exhaust gas, reducing the black smoke emanating from a diesel engine, and improving the rate of fuel consumption.

13 Claims, 4 Drawing Sheets

APPARATUS FOR ENHANCING ENGINE PERFORMANCE

BACKGROUND OF THE INVENTION

This invention relates to an apparatus for enhancing the performance of an engine, especially an automobile engine. More particularly, this invention relates to an engine performance enhancing apparatus disposed near an automobile engine as on the reverse side of a hood or directly above an engine compartment and adapted to enhance the efficiency of combustion of the engine by virtue of an external action, improve the output of the engine, and suppress the occurrence of noxious substances in the exhaust gas.

Various studies and numerous proposals aimed at enhancing engine performance have been made to date, including inventions which are directed to improving fuel injection devices so as to lower the fuel consumption and effect ideal injection and combustion of fuel (as disclosed in Japanese Patent Publication No. SHO 47(1972)-5,862 and Japanese Patent Publication No. SHO 49(1974)-47,922, for example) and inventions which are directed to improving air suction ducts and exhaust gas ducts in cylinder heads so as to impart a spiral flow to the incoming air (as disclosed in Japanese Patent Publication No. SHO 40(1965)-26,281 and Japanese Patent Publication No. SHO 47(1972)-24,765, for example).

The studies made to date have been invariably aimed at attaining internal improvements directly relating to the engine such as improvements in the internal structure of engine and the fuel. The idea of improving the engine performance and suppressing the occurrence of noxious substances in the exhaust gas owing to an external action as conceived in the present invention has never been known to the art.

It has been held that the improvement of the engine performance and the suppression of the occurrence of noxious substances in the exhaust gas are not simultaneously fulfilled by the conventional technique originating in the point of view mentioned above. In the case of a diesel engine, for example, it suffices to increase the cylinder pressure for the purpose of decreasing the noxious substances (such as CO and NOx) and minute particles formed by the adsorption of hydrocarbons and lead sulfate on soot both occurring in the exhaust gas. The increased cylinder pressure, however, elevates the temperature of combustion, encourages the occurrence of nitrogen oxides, and spurs on the phenomenon of knocking. For the same purpose, there may be conceived a method which comprises incorporating a filter halfway in the length of the exhaust gas duct and stripping the exhaust gas of the minute particles having hydrocarbons and lead sulfate adsorbed on soot. This method, however, entails a problem in that the filter is destined to be clogged with the minute particles and the cost of an engine is increased.

The automobile manufacturers, therefore, have been spending enormous amounts of money and ample time in conducting studies on the problem of graphite and exhaust gas in engines, especially diesel engines. In spite of all of these efforts, the problem has not been fully solved yet. It is difficult to fulfill the improvement of the engine performance and the suppression of the occurrence of noxious substances in the exhaust gas at the same time by the conventional technique. This is because the internal improvements of engine such as the improvements in the internal structure of engine and the improvement in the fuel have reached their substantial limits.

This invention approaches the task of enhancing the engine performance and overcoming the urgent social problem of air pollution by the automobile exhaust gas from an angle totally different from that of the conventional technique.

SUMMARY OF THE INVENTION

An object of this invention is to provide an engine performance enhancing apparatus which is capable of enhancing the efficiency of combustion in the engine owing to an action produced outside the engine, improving the output of the engine, and decreasing the noxious substances in the exhaust gas.

Another object of this invention is to provide an engine performance enhancing apparatus which contributes to improving the rate of fuel consumption and solving the problem of exhaust gas and which is simple in structure and inexpensive to manufacture.

To accomplish the objects described above, according to the present invention, there is provided an engine performance enhancing apparatus which comprises a plurality of disklike copper pieces arranged lattice wise and sandwiched between two sheets or cloths, copper mesh superposed on the opposite outer surfaces of each of said sheets or cloths, and aluminum sheets superposed on the opposite outer surfaces of said copper mesh and fastened.

This apparatus, on being simply installed near a given automobile engine, brings about beneficial effects of enhancing the output of the engine and, at the same time, decreasing the content of noxious substance in the exhaust gas, reducing the black smoke emanating from the diesel engine, and improving the rate of fuel consumption.

Other objects, features, and advantages of this invention will become more apparent as the disclosure is made in the following description of preferred embodiments of the invention, as illustrated in the accompanying drawings.

DETAILED DESCRIPTION OF THE PREFERRED EMBODIMENT

Figure 1:
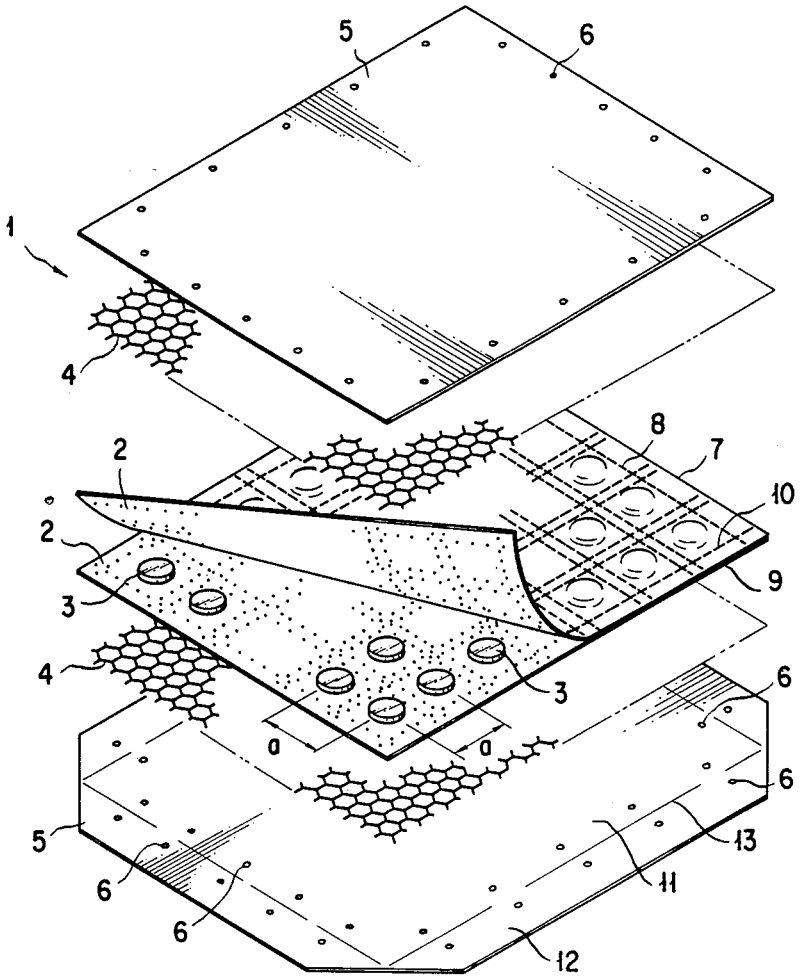
FIG. 1 is an exploded perspective view illustrating one preferred embodiment of the engine performance enhancing apparatus according to this invention.
Figure 2:
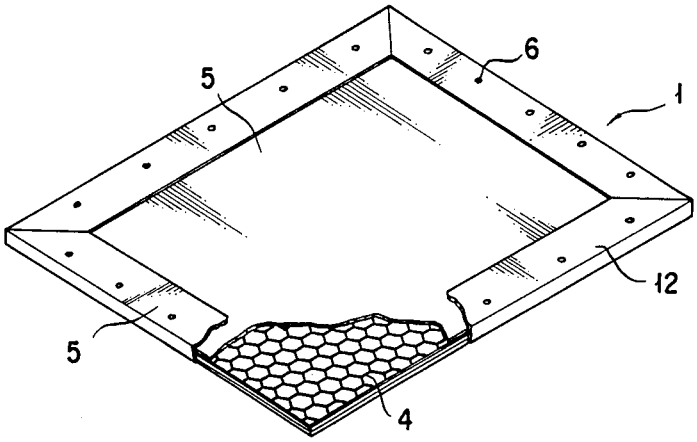
FIG. 2 is a partially sectioned perspective view illustrating the apparatus of FIG. 1 in an assembled state.

The engine performance enhancing apparatus of this invention is illustrated generally at 1 in FIG. 1 and FIG. 2. The component elements of the engine performance enhancing apparatus are apparent from FIG. 1 and the assembled state thereof is apparent from FIG. 2.

First, two sheets of cloth of cotton, rayon, etc. or synthetic resin sheet, for example, measuring approximately 40 to 80 cm in length and 40 to 80 cm in width are prepared. For the sheet of cloth, cotton is more desirable than any other material available at all. On one of the two sheets of cloth 2, about 60 to 300 disklike copper pieces 3 are arranged lattice wise as illustrated in FIG. 1. The other sheet of cloth 2 is placed to cover the copper pieces 3. The two sheets of cloth 2 thus opposed to each other across the copper pieces are joined by sewing so that lattice intervals a separating the copper pieces will not vary appreciably. The copper of which the disklike pieces 3 are made is desired to have purity of not less than 99.9%. Though the number, size, thickness, and lattice interval of the disklike copper pieces 3 are variable with the engine's displacement, the disklike copper pieces 3 generally have a diameter in the range of 16 to 38 mm and a thickness in the range of 0.6 to 2 mm. The lattice interval a, i.e. the distance between the center of one disklike copper pieces 3 and the center of an adjacent disklike copper piece 3, is selected in the range of 2.2 to 5.3 cm. In the illustrated embodiment, the disklike copper pieces 3 are so arranged that the sides of unit lattice squares will fall parallel to the sides of the sheets of cloth 2. Optionally, they may be arranged so that the sides of the unit lattice squares will fall at angles of 45° relative to the sides of the sheets of cloth 2.

Now, the manner in which the lattice intervals a are provided between the disklike copper pieces 3 will be described below. First, the two tacked sheets of cloth 2 are sewn along a line running parallel to one edge side (referred to as "longitudinal side 7" for the sake of convenience) and separated by a distance of 0.2 to 0.9 cm from the longitudinal side 7. Then, they are sewn likewise along lines running parallel to the longitudinal stitch line 8 and separated by fixed intervals of 2 to 4.4 cm from the longitudinal stitch line 8. The spaces 2 to 4.4 cm in width consequently formed and enclosed by the two sheets of cloth are destined to admit disklike copper pieces. The sewing of the two sheets of cloth is repeated along other lines running parallel to the longitudinal stitch line and separated by fixed alternate intervals of 0.2 to 0.9 cm and 2 to 4.4 cm until the spaces to be formed will suit the total number of disklike copper pieces 3. Subsequently, the two sheets of cloth are sewn along a line running parallel to the other edge side referred to as "lateral side 9" for the sake of convenience) perpendicular to the longitudinal side 7 mentioned above and separated by a distance of 0.2 to 0.9 cm from the lateral side 9. Then, disklike copper pieces 3 are inserted one each in the intervals of 2 to 4.4 cm between the longitudinal stitch lines. The next sewing in the lateral direction is made along a line running parallel to the lateral stitch line 10 and separated by an interval of 2 to 4.4 cm from the lateral stitch line 10. The sewing in the lateral direction is again made along a line running parallel to the lateral stitch line and separated by an interval of 0.2 to 0.9 cm from the previous lateral stitch line. The disklike copper pieces 3 are similarly inserted one each in the intervals of 2 to 4.4 cm between the longitudinal stitch lines. In this manner, the sewing in the lateral direction is repeated along parallel lines separated by alternate intervals of 2 to 4.4 cm and 0.2 to 0.9 cm, with the insertion of disklike copper pieces 3 in the intervals between the longitudinal stitch lines separated by fixed intervals of 2 to 4.4 cm suitably continued in the meantime so as to suit the total number of the disklike copper pieces.

In consequence of the sewing, a pouchy enclosure is formed in such a manner that the disklike copper pieces 3 will be arranged latice wise, sandwiched between the opposed sheets of cloth 2, and lodged in the intervals of 2 to 4.4 cm separating the longitudinal stitch lines 8 and the lateral stitch lines 10. Two sheets 4 of hexagonal copper mesh are superposed, one each on the opposite outer surfaces of the sheets of cloth 2. The copper of which the sheets of mesh 4 are made is also desired to have purity of not less than 99.9%. The sheets of copper mesh 4 thus superposed on the sheets of cloth are trimmed to have the edges thereof aligned with those of the pouchy enclosure. The size of the hexagonal meshes of the copper mesh 4 is preferably selected in the range of 16×8 to 30×15 mm (maximum diameter×length of side).

Now, two aluminum sheets 5 having aluminum purity of not less than 99.5% and a thickness in the range of 0.6 to 1 mm are prepared. One of them has an area of a square of 41 to 81 cm, with holes 6 for reinforcement of attachment perforating the sheet 5, the holes 6 being suitably spaced along the four sides. The other aluminum sheet 5 has an area of the square of 44 to 84 cm, with the four corners thereof cut off as illustrated in FIG. 1 so as to give rise to folding edge parts 12 one each along the four sides of a square 11 equalling the square of the smaller aluminum sheet (upper aluminum sheet as shown in FIG. 1). Along the four sides of this square 11, holes 6 are perforated at the positions matched to those of the holes 6 perforated in the smaller aluminum sheet 5. In the folding edge parts 12, holes 6 are perforated in symmetry with the aforementioned holes 6 relative to the folding lines 13 as boundaries. The two sheets of copper mesh 4 of hexagonal meshes, superposed one each on the opposite outer surfaces of the pouchy enclosure having the lattice wise arranged disklike copper pieces 3 sandwiched therebetween as illustrated in FIG. 2, are interposed between the two aluminum sheets 5. Then, the folding edge parts 12 of the larger aluminum sheet 5 are folded along the folding lines 13 and laid fast over the smaller aluminum sheet so that the two aluminum sheets will not deviate from each other.

Figure 3:
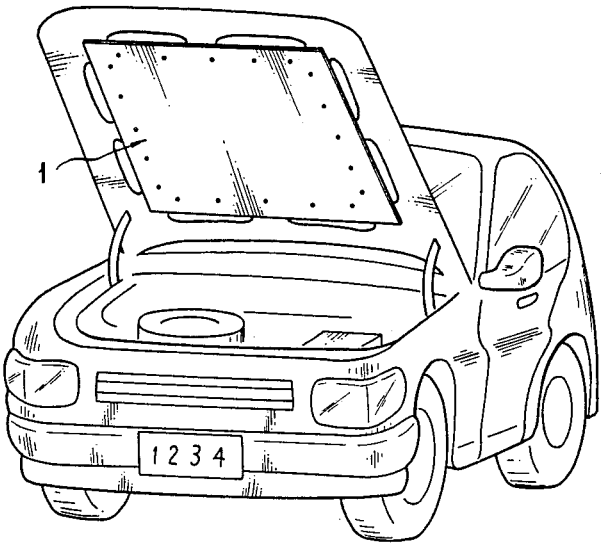
FIG. 3 is a perspective view illustrating the apparatus of this invention in a state attached to the reverse side of the hood of an automobile.
Figure 4:
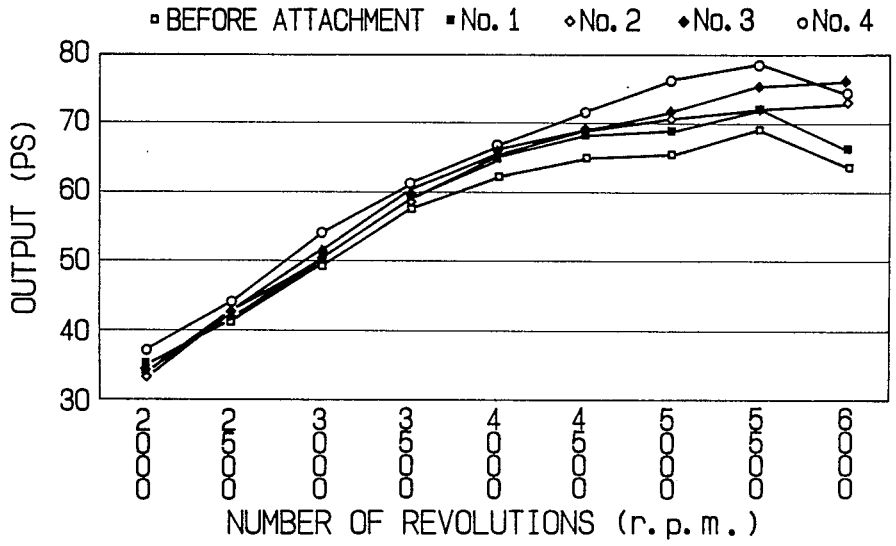
FIG. 4 and FIG. 5 are graphs showing changes of the output of an automobile, engine having the apparatus of this invention fastened to the reverse side of the hood.
Figure 5:
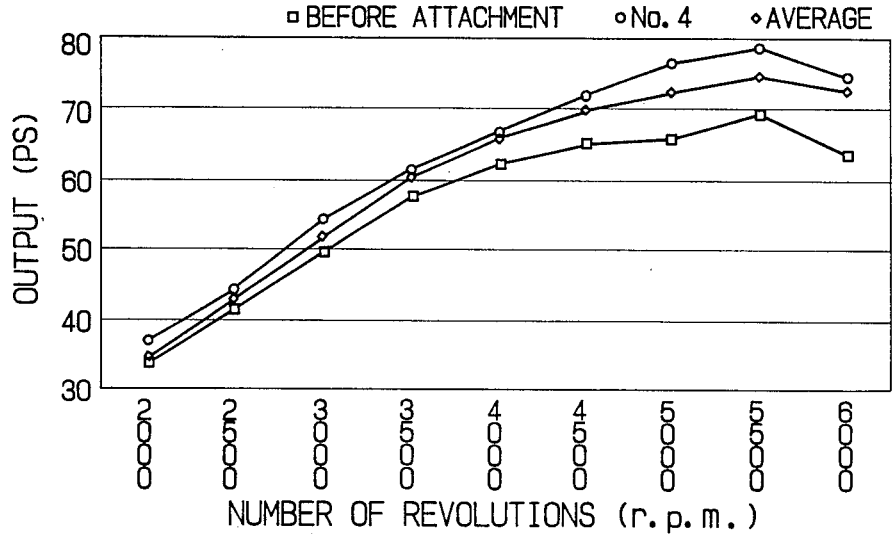
Figure 6:
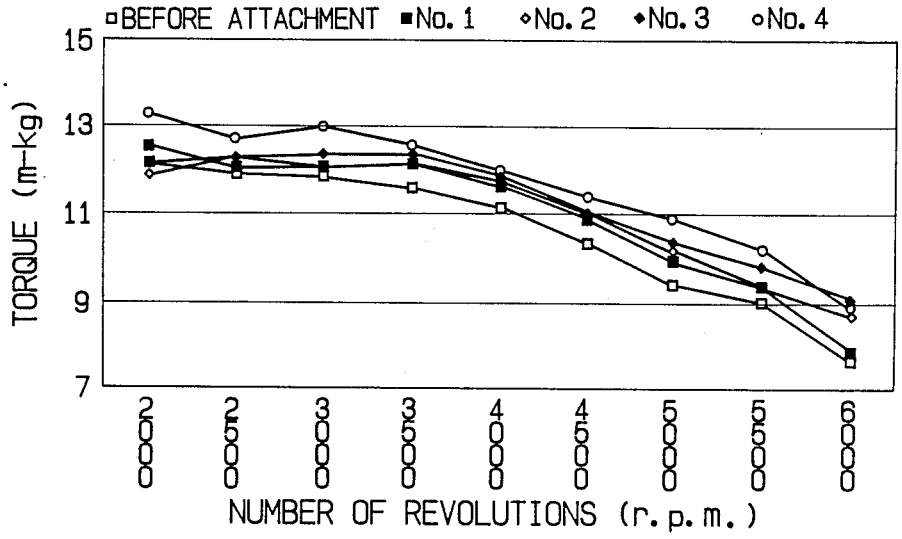
FIG. 6 and FIG. 7 are graphs showing changes of the torque of an automobile engine, having the apparatus of this invention fastened to the reverse side of the hood.
Figure 7:
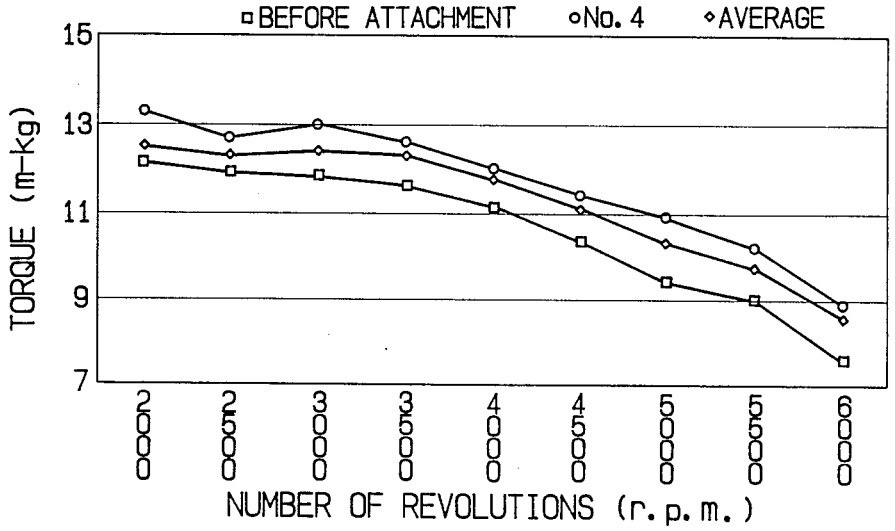

To be ready for use, the engine performance enhancing apparatus constructed as described above is applied tightly to the reverse side of the automotive hood or bonnet above the engine compartment and then fastened thereto by suitable means such as screws or hooks as illustrated in FIG. 3. Optionally, wires may be passed through the holes 6 formed along the four sides of the vertically superposed two aluminum sheets 5 and then tied to the framework on the reverse side of the hood so as to reinforce the engine performance enhancing apparatus enough to withstand vibrations. The wires are desired to be made of copper.

Now, the results of the test performed on the apparatus of this invention mounted on an automobile will be described below. The specification of the engine performance enhancing apparatus used in this test is as follows.

| | |
|---|---|
| Overall size: | 56 × 56 cm |
| Disklike copper pieces: | A total of 196 pieces (14 × 14), each measuring 2.8 cm in diameter and 1 mm in thickness |

-continued

| | |
|---|---|
| Size of hexagonal mesh of copper mesh: | 10 × 20 mm |
| Thickness of aluminum sheets: | 0.6 mm (both upper and lower sheets) |
| Material of sheets of cloth: | Cotton |

Test 1:

The engine performance enhancing apparatus specified above was fastened with screws to the reverse side of an automotive hood and reinforced with copper wires passed through the holes formed along the four sides of the aluminum sheets and tied to the framework on the reverse side of the hood. The engine was operated before and after the attachment of the engine performance enhancing apparatus to determine changes in output and changes in torque due to the use of the apparatus. Test No. 1 represents a test run in which the test after the attachment of the apparatus was performed immediately after the test before the attachment thereof, while Test No. 2 to No. 4 represent test runs in which each test after the attachment was performed at approximately two to three months, interval from the previous test after the attachment when the test environmental (weather) conditions are found to be approximately similar to those of the first test. The particulars concerning the test were as follows.

-continued

| Vehicle used: | |
|---|---|
| Name of vehicle: | Nissan "LIBERTA VILLA" ® (produced by Nissan Motor Co., Ltd.) |
| Displacement: | 1,500 cc |
| Model: | E-HN12 |
| Model of motor: | E-15 |
| Transmission: | 5 MT |

-continued

| Vehicle used: | |
|---|---|
| Distance of travel: | 56,000 km |
| Year of manufacture: | 1984 |
| Fuel: | Regular gasoline |
| Testing instrument: | BOSCH chassis dynamo |
| Place of testing: | Clover Motor Ltd. 2115 Oaza Higashi, Maebara-cho, Itoshima-gun, Fukuoka-ken |

The results of the test were as shown in Table 1, Table 2, and FIGS. 4 to 7, FIG. 5 and FIG. 7 are graphs obtained by plotting the average values the engine output is measured in PS which is approximately equal to horsepower. 1 PS equals 735.5W, whereas 1 horsepower equals 746W.

TABLE 1

| Revolution number | Before attachment | Changes in output: After attachment No. 1 | No. 2 | No. 3 | No. 4 | Average*1 | Output (PS) Difference*2 |
|---|---|---|---|---|---|---|---|
| 2000 | 33.9 | 35.0 | 33.2 | 34.0 | 37.1 | 34.8 | 3.2 |
| 2500 | 41.6 | 42.0 | 42.9 | 42.9 | 44.3 | 43.0 | 2.7 |
| 3000 | 49.7 | 50.7 | 50.5 | 51.7 | 54.3 | 51.8 | 4.6 |
| 3500 | 57.7 | 59.5 | 59.5 | 60.6 | 61.4 | 60.3 | 3.7 |
| 4000 | 62.3 | 65.1 | 65.6 | 66.2 | 66.8 | 65.9 | 4.5 |
| 4500 | 65.1 | 68.6 | 69.2 | 69.4 | 71.8 | 69.8 | 6.7 |
| 5000 | 65.8 | 69.3 | 71.0 | 71.9 | 76.4 | 72.2 | 10.6 |
| 5500 | 69.3 | 72.1 | 72.1 | 75.4 | 78.5 | 74.5 | 9.2 |
| 6000 | 63.7 | 66.1 | 72.8 | 76.1 | 74.3 | 72.3 | 10.6 |

*1Average = (No. 1 + No. 2 + No. 3 + No. 4)/4
*2Difference = No. 4 − Value before attachment

TABLE 2

| Revolution number | Before attachment | Changes in torque: After attachment No. 1 | No. 2 | No. 3 | No. 4 | Average*1 | Torque (m-Kg) Difference*2 |
|---|---|---|---|---|---|---|---|
| 2000 | 12.15 | 12.52 | 11.89 | 12.17 | 13.3 | 12.5 | 1.15 |
| 2500 | 11.93 | 12.02 | 12.29 | 12.27 | 12.7 | 12.3 | 0.77 |
| 3000 | 11.86 | 12.11 | 12.05 | 12.34 | 13.0 | 12.4 | 1.14 |
| 3500 | 11.61 | 12.17 | 12.17 | 12.39 | 12.6 | 12.3 | 0.99 |
| 4000 | 11.15 | 11.65 | 11.74 | 11.85 | 12.0 | 11.8 | 0.85 |
| 4500 | 10.35 | 10.91 | 11.01 | 11.04 | 11.4 | 11.1 | 1.05 |
| 5000 | 9.42 | 9.92 | 10.17 | 10.34 | 10.9 | 10.3 | 1.48 |
| 5500 | 9.02 | 9.38 | 9.39 | 9.82 | 10.2 | 9.7 | 1.18 |
| 6000 | 7.60 | 7.89 | 8.69 | 9.08 | 8.9 | 8.6 | 1.30 |

*1Average = (No. 1 + No. 2 + No. 3 + No. 4)/4
*2Difference = No. 4 − Value before attachment It is clearly noted from the results of test given above that the attachment of the engine performance enhancing apparatus of this invention resulted in improving the engine output by approximately 5 to 15%. The torque acceleration and the slope climbing force were improved proportionately. It is further noted from the same test results that the engine performance was improved in proportion as the revolution number increased and the duration of the use of the apparatus increased.

Test 2:

The automobile was operated before and after the attachment of the engine performance enhancing apparatus of this invention to determine changes in exhaust gas due to the use of the apparatus. The automobile used in this test was the same as that used in Test 1 described above. In this test, an infrared type automobile exhaust gas tester (produced by Nissan Motor Co., Ltd.) and a Kitagawa type gas sensor were used as measuring instruments. The results of this test were as shown in Table 3.

TABLE 3

| Components | Average values of measurement of exhaust gas: Before attachment | After attachment |
|---|---|---|
| Hydrocarbons (ppm) | 83.3 | 0 |
| Carbon monoxide (%) | 0.27 | 0 |
| Nitrogen oxides (ppm) | 350.0 | 39 |

From the results of test given above, it is clear that the engine performance enhancing apparatus of this invention enabled the engine to effect complete combustion of the fuel.

Test 3:

The same automobile (Nissan "LIBERTA VILLA" ®) as used in Test 1 described above and another automobile Nissan "March" ® (model: KO, model of motor: MA10S, displacement: 1,000 cc, year of manufacture: 1986, and fuel: regular gasoline), each provided with the engine performance enhancing apparatus of this invention, were subjected to comprehensive fuel testing under various road conditions simulated to be like those experienced in everyday use of an automobile. As a measuring instrument, Fuel Pet, a trade name of Kabushiki Kaisha Nippon Tokushukiki Seisakusho of Japan for a gasoline engine fuel measuring device, was used for the test on Nissan "LIBERTA VILLA" ® and Zemco ZT-3 Drive Computer a trade name of Zemco, Inc. of the United States for a drive computer including a speed sensor and a fuel flow sensor, for the test on Nissan "March" ®, in accordance with the full-tank method using a measuring cylinder. The results of the test were as shown in Table 4.

TABLE 4

| Kind of car | Fuel consumption after attachment: Total distance of travel (Km) | Fuel Consumed (lit.) | Rate of fuel consumption (Km/l) |
|---|---|---|---|
| Nissan "LIBERTA VILLA" | 965.0 | 48.63 | 19.84 |
| Nissan "March" | 221.1 | 8.34 | 26.51 |

From the test results, it is clear that the use of the engine performance enhancing apparatus of this invention notably improved the rate of fuel consumption and permitted a saving of fuel cost by more than 20%. This fact coupled with the test results described above implies that this enhanced fuel economy was attained because the fuel was allowed complete combustion, the combustion velocity was increased and, at the same time, the explosive pressure was exalted.

A fully plausible theory for permitting logical explanation of the enhancement of the engine performance and the suppression of the content of noxious substances in the exhaust gas to be brought about by the use of the engine performance enhancing apparatus of this invention remains yet to be explored.

The fact that the various tests described above yielded results which indicated thorough elimination of HC and CO from the exhaust gas and decrease of the NOx content in the exhaust gas will clearly imply that the mixture of the fuel with the air proceeded ideally and the fuel underwent complete combustion. The reason for this favorable situation remains yet to be elucidated. The following postulate, however, is believed to offer a logical explanation of this situation.

When an object is heated, it radiates an electromagnetic wave particularly in the infrared region. This phenomenon occurs in infrared radiation heaters, for example. In the case of an engine, when the engine is operated, the material of which the engine is made is heated to a very high temperature. As the result, the heated engine will radiate a large number of electromagnetic waves. When one of these electromagnetic waves impinges on the apparatus of this invention, it will be reflected by the aluminum sheet 5 forming the outer side of the apparatus or partially absorbed by the aluminum sheet 5 and spent in heating it. The reflected electromagnetic wave will be absorbed by the gasoline (organic substance), an absorbent for electromagnetic wave and allowed to impart vibration to the molecules of the gasoline. As a result, the particles of the gasoline are believed to be activated to the extent of allowing the gasoline to be thoroughly mixed with the air and improving the efficiency of combustion. If the apparatus was provided solely with aluminum sheets, it would tend to bring about the effect of this invention to a slight extent but would not bring about the effect of this invention fully. It will be, therefore, logical to infer that the electromagnetic waves radiated from the engine itself may be reflected and utilized and the electromagnetic waves are radiated from the apparatus of this invention as well. The reason for this inference may be explained by citing the phenomenon that when the opposite ends of two conductors of different materials are joined and the two junctions consequently formed are kept at different temperatures, the circuit gives rise to electromotive force (thermoelectromotive force) and induces flow of thermoelectric current. Specifically, the aluminum sheet on the engine side is heated by the heat-radiating energy from the engine and the aforementioned electromagnetic energy and the edge part of this aluminum sheet is connected to the cold copper mesh 4 of a different material which are connected to the aluminum sheet on the opposite side. Thus, the aluminum sheet will give rise to thermoelectromotive force and permit flow of electric current through the copper nets. The sheets of cloth 2, an insulating substance (dielectric substances), are interposed between the two sheets of copper mesh and, therefore, will be enabled to constitute a capacitor of one kind. The multiplicity of disklike copper pieces 3 arranged lattice wise between the two sheets of cloth 2 will be enabled to induce and store electric charge. When the electric charge is accumulated to a certain degree, electric current will begin to flow through the spaces intervening between the individual disklike copper pieces 3. By the principle similar to that of an antenna, the disklike copper pieces 3 will radiate electromagnetic waves This explanation is believed to be consistent with the fact that the effect of this invention grows in proportion as the duration of the attachment of the apparatus of this invention increases (because the magnitude of the electric charge stored in the disklike copper pieces will increase in proportion as the duration of the attachment and the operation of the engine are lengthened). For the effect of this invention to be manifested fully, the copper pieces are required to be formed in a circular shape like a disk. This requirement may be explained by the directivity which represents the relation between the intensity and the direction of radiation of the electromagnetic waves. Further, in accordance with the principle described above, it will be evident that the lattice distance a has the optimum range of its own.

The present inventor is not so bold as to believe that the explanation given so far has fully elucidated the function or action of the apparatus of this invention. The theory capable of logically explaining the aforementioned phenomena remains yet to be developed. The effect produced by this invention, however, is a fact which can be confirmed through a follow-up experiment by any person skilled in the art.

The number, size, and thickness of the disklike copper pieces 3, the lattice distance a, and the size and correction coefficient of the metal mesh 4 of hexagonal meshes and the aluminum sheets 5 are variable with the magnitude of the displacement of the engine and can be suitably selected, depending on the displacement of the engine. It will be easily understood that the engine performance enhancing apparatus of this invention need not be limited to automobile engines but may be applied to various engines such as for motorcycles, small boats and ships, and airplanes when the number, size, and thickness of the disklike copper pieces 3, the lattice distance a, and the size and correction coefficient of the metal mesh 4 of hexagonal meshes and the aluminum sheets 5 are suitably selected.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

What is claimed is:

1. An engine performance enhancing apparatus, comprising a plurality of disklike copper pieces arranged lattice wise and interposed between two cloths, a sheet of copper mesh superposed on the opposite outer surface of each of said cloths, and an aluminum sheet superposed on the opposite outer surface of each of said sheets of copper mesh and fastened.

2. An apparatus according to claim 1, wherein said cloths are cotton cloth, rayon cloth, or synthetic resin sheets.

3. An apparatus according to claim 1, wherein said disklike copper pieces are made of copper having a purity of not less than 99.9%.

4. An apparatus according to claim 1, wherein said disklike copper pieces have a diameter in the range of 16 to 38 mm and a thickness in the range of 0.6 to 2 mm.

5. An apparatus according to claim 1, wherein said mesh is made of copper having a purity of not less than 99.9%.

6. An apparatus according to claim 1, wherein said copper mesh has hexagonal meshes.

7. An apparatus according to claim 6, wherein said hexagonal meshes measure 8 to 15 cm in length of side and 16 to 30 cm in maximum diameter.

8. An apparatus according to claim 1, wherein said aluminum sheets are made of aluminum having a purity of not less than 99.5%.

9. An apparatus according to claim 1, wherein said aluminum sheets have a thickness in the range of 0.6 to 1 mm.

10. An apparatus according to claim 1, wherein the lattice distance between said disklike copper pieces is in the range of 2.2 to 5.3 cm.

11. An apparatus according to claim 1, wherein said two cloths are joined to each other in such a manner that the plurality of disklike copper pieces arranged lattice wise between said two cloths will not deviate from position.

12. An apparatus according to claim 1, wherein said two cloths, said two sheets of copper mesh, and one of said two aluminum sheets have a substantially identical area and the remaining aluminum sheet has folding edge parts outside the boundaries of an area substantially identical with said area, said two cloths having said cooper pieces interposed therebetween and said two sheets of copper mesh superposed on the opposite outer surfaces of said cloths are interposed between said one aluminum sheet and said other aluminum sheet like a sandwich, and the folding edge parts of said other aluminum sheet are folded back over the outer surface of said one aluminum sheet.

13. An apparatus according to claim 12, wherein said two cloths and said two sheets of copper mesh each have the area of a square having a side of about 40 to 80 cm, said one aluminum sheet has the area of a square having a side of about 41 to 81 cm, and said other aluminum sheet has an area of a square having a side of about 44 to 84 cm.

* * * * *